US007824006B2

(12) United States Patent
Park

(10) Patent No.: US 7,824,006 B2
(45) Date of Patent: Nov. 2, 2010

(54) IMAGE FORMING APPARATUS AND METHOD TO OPERATIVELY CONTROL THE SAME

(75) Inventor: Min-su Park, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 819 days.

(21) Appl. No.: 11/680,808

(22) Filed: Mar. 1, 2007

(65) Prior Publication Data

US 2008/0024537 A1 Jan. 31, 2008

(30) Foreign Application Priority Data

Jul. 25, 2006 (KR) ..... 10-2006-0069913

(51) Int. Cl.
*B41J 2/165* (2006.01)

(52) U.S. Cl. ..... 347/33

(58) Field of Classification Search ..... 347/32–35
See application file for complete search history.

(56) References Cited

U.S. PATENT DOCUMENTS 5,266,974 A * 11/1993 Koitabashi et al. ..... 347/33
5,953,025 A 9/1999 Sakurai
6,000,780 A * 12/1999 Schwiebert et al. ..... 347/33
6,641,245 B1 * 11/2003 Kelly et al. ..... 347/19
6,830,319 B2 * 12/2004 Harajiri et al. ..... 347/68
2003/0234833 A1 12/2003 Kim
2005/0151781 A1 7/2005 Oku
2006/0066665 A1 * 3/2006 Kachi et al. ..... 347/33
2006/0268050 A1 * 11/2006 Sonobe ..... 347/29

FOREIGN PATENT DOCUMENTS

EP 1 533 123 A2 5/2005

OTHER PUBLICATIONS

European Search Report issued Sep. 29, 2008 (Europe Application No. 07106774.8).

* cited by examiner

*Primary Examiner*—Julian D Huffman
*Assistant Examiner*—Jason S Uhlenhake
(74) *Attorney, Agent, or Firm*—Stanzione & Kim LLP

(57) ABSTRACT

An image forming apparatus and method to operatively control the same. The apparatus includes an ink cartridge having a plurality of print heads arranged in a widthwise direction of a print medium, a wiping unit to wipe the print heads while moving in the print medium feeding direction, a positional information providing unit to provide positional information about a position of the wiping unit, and a controller to operatively control the print heads. The controller controls the print heads that, on the basis of the positional information provided and offset information of the ink cartridge, the controller estimates a wiping timing to wipe the nozzles of the print heads with the wiping unit and determines a spitting timing to eject a predetermined amount of ink in the wiped sequence of the nozzles, whereby that the wiping and spitting operations are performed at the estimated wiping timing and the determined spitting timing.

31 Claims, 12 Drawing Sheets

IMAGE FORMING APPARATUS AND METHOD TO OPERATIVELY CONTROL THE SAME

CROSS-REFERENCE TO RELATED APPLICATIONS

This application claims priority under 35 U.S.C. §119(a) from Korean Patent Application No. 10-2006-069913, filed Jul. 25, 2006, in the Korean Intellectual Property Office, the entire disclosure of which is hereby incorporated by reference.

BACKGROUND OF THE INVENTION

1. Field of the Invention

The present general inventive concept relates to an image forming apparatus and a method to operatively control the same, and more particularly, to an array type image forming apparatus having a plurality of print heads arranged in a widthwise direction of a print medium, such as a paper, and a method for operatively controlling the same.

2. Description of the Related Art

In general, an image forming apparatus, such as an ink-jet printer, ejects fine droplets of inks to desired positions on a print medium, such as a paper or a cloth, so as to print a predetermined color image on a surface of the print medium. A conventional ink-jet printer includes an ink cartridge for printing an image while reciprocating in a direction at a right angle to a print medium feeding direction, i.e., in a widthwise direction of the print medium. However, such a conventional ink-jet printer with an ink cartridge for printing an image while reciprocating has a disadvantage in that a printing speed is very slow.

Recently, ink-jet printers have been developed to employ an ink cartridge having a plurality of print heads arranged over the entire width of a print medium, so that an image can be rapidly printed without reciprocating the ink cartridge. Such ink-jet printers are also referred to as array print head type ink-jet printers.

A conventional array print head type ink cartridge includes a plurality of ink tanks, each for storing a print ink, a plurality of negative pressure adjustment units connected to the ink tanks, respectively, a plurality of print heads arranged in a predetermined pattern in the widthwise direction of a print medium, and a ink channel unit for supplying inks from the ink tanks to the print heads.

The ink tanks are mounted on a frame and contain various colors of inks, e.g., yellow (Y), magenta (M), cyan (C) and black (B) inks, respectively.

The negative pressure adjustment units are mounted on the underside of the frame and communicated with the ink tanks, respectively. Such negative pressure adjustment units produce negative pressure so as to prevent the leakage of ink.

The ink channel unit is connected with the negative pressure adjustment units and serves to supply inks admitted from the ink tanks through the negative pressure adjustment units to each of the print heads.

The print heads are arranged in a predetermined pattern on and attached to the front face of the ink channel unit. Each of the print heads is formed with a plurality of nozzles, through which inks supplied from the ink channel unit is ejected onto a print medium, whereby an image is printed on the print medium. In particular, the nozzles are divided according to colors. Typically, the color-specific nozzles are sequentially arranged in the print medium feeding direction.

The above-mentioned array print head type image forming apparatus is advantageous in that the output speed is increased and the construction is simplified. However, such an array print head type image forming apparatus has various problems as follows.

In order to wipe the print heads arranged in the widthwise direction, it is necessary to move a blade in the widthwise direction of a print medium or in the print medium feeding direction, so that the blade wipes the print heads. If a blade is arranged to wipe the print heads while moving in the widthwise direction, a large amount of ink is attached to the blade while wiping the print heads because the blade employed in this type has a small area. Therefore, the blade is not capable of performing a normal wiping operation for a long period, and the length of time required for wiping is very long.

For this reason, there has been proposed to arrange an elongated blade in the widthwise direction of a print medium and to move the elongated blade in the print medium feeding direction, thereby wiping the print heads. However, if the print heads are wiped in this manner, inks are pushed into color-specific nozzles sequentially arranged in the print medium feeding direction, thereby causing color-mixing in the nozzles, which causes a problem in maintenance of a printed image.

Therefore, what is needed is a method which can quickly and cleanly wipe the print heads and solve or at least alleviate the problem of color-mixing.

SUMMARY OF THE INVENTION

The present general inventive concept provides an image forming apparatus, the print heads of which can be easily wiped by a simple arrangement, and a method to operatively control the same.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an image forming apparatus, including an ink cartridge having a plurality of print heads arranged in a widthwise direction of a print medium, a wiping unit to wipe the print heads while moving in the print medium feeding direction, a positional information providing unit to provide positional information about a relative position of the wiping unit in relation to the nozzles of the print heads when the wiping unit is operated, and a controller to operatively control the print heads in such a manner that on the basis of the positional information provided from the positional information providing unit and offset information of the ink cartridge, the controller estimates a wiping timing to wipe the nozzles of the print heads with the wiping unit and determines a spitting timing to eject a predetermined amount of ink in the wiped sequence of the nozzles, whereby that the wiping and spitting operations are performed at the estimated wiping timing and the determined spitting timing, respectively.

The print heads may be arranged in first and second rows so that the print heads are parallel to the widthwise direction and spaced from each other in the print medium feeding direction, and the wiping unit firstly wipes the print heads of the first row and then wipes the print heads of the second row.

The offset information may include head offsets of the print heads in relation to the medium feeding direction, each head offset corresponding to one of the print heads, and nozzle offsets of each of the print heads in the medium feeding direction.

On the basis of the head offset information of the first and second rows and the positional information of the wiping unit, the controller may determine the spitting timing at the time of completing the wiping operation of the first row and control the spitting operation to be performed at the determined spitting timing.

On the basis of the nozzle offset information of the print heads of each of the rows and the positional information of the wiping unit, the controller may control the spitting operation to be performed for each of the nozzles of each of the print heads at the time the wiping operation is completed for the corresponding nozzle.

The wiping unit may include a plurality of blades arranged in the widthwise direction to be parallel to each other to wipe the print heads, a frame to support the plurality of blades and having a reservoir to receive the ink ejected from wiped print heads, a driving unit to drive the frame in such a manner as to reciprocate along a predetermined path so that the nozzle surfaces of the print heads are wiped by the blades, and a driving motor to provide the driving unit with a power.

The plurality of blades may include a pair of the blades which are arranged parallel to each other in the widthwise direction.

The positional information providing unit may include an encoder connected to the driving motor.

The positional information providing unit may include an encoder connected to a driving motor to provide a power to drive the wiping unit.

The offset information of the ink cartridge may be previously set and stored in a memory.

The offset information may include head offsets of the print heads in relation to the printing medium feeding direction, each offset corresponding to one of the print heads, and nozzle offsets for each of the print heads in relation to the printing medium feeding direction.

The controller may control each of the print heads in such a manner that on the basis of the head offset and nozzle offset information and the positional information, the controller estimates the wiping completion timing for each of the nozzles of each of the print heads in relation to the print medium feeding direction and renders the corresponding nozzle to perform the spitting operation at the wiping completion timing.

The foregoing and/or other aspects and utilities of the present general inventive concept may be also achieved by providing a method to operatively control an image forming apparatus, including acquiring offset information for a plurality of print heads arranged in a widthwise direction, moving one or more blades so as to wipe a plurality of nozzles of the print heads arranged in the widthwise direction with the blades, acquiring positional information of the blades, estimating wiping timing for the print heads on the basis of the acquired positional information and offset information, determining spitting timing to eject ink so as to remove admitted into the nozzles of wiped print heads on the basis of the estimated wiping timing, and ejecting ink from the nozzles of corresponding print heads at the determined spitting timing.

The offset information may include head offsets for the print heads in relation to the printing medium feeding direction, each head offset corresponding one of the print heads, and nozzle offsets of each of the print heads in the print medium feeding direction.

The moving of the one or more blades may include arranging the blades having a length corresponding to the width of the print medium; and moving the blades in the print medium feeding direction.

The acquiring of the positional information may include rotationally driving the driving motor to move the blades; and calculating the moving distance of the blades from the initial positions thereof on the basis of a count value of an encoder connected to the driving motor.

The obtaining of the spitting timing may include determining the spitting timing in such a manner as to be performed for each of the nozzles in the sequence of the wiped nozzles just after so that the spitting timing corresponds to the sequential completion of the wiping of the nozzles of each of the print heads in the print medium feeding direction.

The foregoing and/or other aspects and utilities of the present general inventive concept may be also achieved by providing an image forming apparatus, including a plurality of print heads to eject ink on a printing medium, the print heads arranged widthwise with respect to a feeding direction of the printing medium and each having a plurality of nozzles, a wiping unit to wipe the print heads, a position unit to provide position information of the wiping unit with respect to the print heads, and a controller to control the print heads to eject ink according to the provided position information of the wiping unit.

The controller may determine a wiping timing to wipe the nozzles of the print heads and may determine an ejection timing to eject a predetermined amount of ink from the wiped nozzles of the print heads.

The controller may control the nozzles to eject the ink as they are sequentially wiped.

The controller may use offset information of the nozzles of the print heads to determine the ejection and wiping timing.

The nozzles may be arranged in rows parallel to the feeding direction of the printing medium, and the controller may control the nozzles to eject the ink as they are sequentially wiped on a row-by-row basis.

The foregoing and/or other aspects and utilities of the present general inventive concept may be also achieved by providing an array-type inkjet printer, including a plurality of nozzles arranged in a widthwise alignment perpendicular to a feeding direction of a printing medium, a wiping unit to wipe a surface of the nozzles, a controlling unit to control the wiping unit and the nozzles to eject a predetermined amount of ink in a spitting operation, wherein the controller controls the nozzles to eject ink sequentially as the nozzles are wiped by the wiping unit.

The nozzles may be arranged in sequential rows of different inks and the controller may control the wiping unit to wipe the nozzles on a row-by-row basis.

The foregoing and/or other aspects and utilities of the present general inventive concept may be also achieved by providing an image forming apparatus, including a print head having first nozzles and second nozzles disposed on a first row and a second row, respectively, and a controller to control the first nozzles and the second nozzles to spit according to an offset information between the first row and the second row.

The apparatus may further include a wiping unit to wipe the print head, wherein the controller controls the first nozzles and the second nozzles to spit according to the offset operation and a relative position of the wiping unit with respect to the print head.

The foregoing and/or other aspects and utilities of the present general inventive concept may be also achieved by providing an image forming apparatus, including a print head having first nozzles and second nozzles disposed on a first row and a second row, respectively, and a control unit to control the first nozzles and the second nozzles to simultaneously spit in a mode and sequentially spit in another mode.

The foregoing and/or other aspects and utilities of the present general inventive concept may be also achieved by providing a method of controlling an image forming apparatus, including acquiring offset information of a plurality of print heads having a plurality of nozzles arranged in a widthwise direction perpendicular to a feeding direction of a printing medium, wiping a surface of the nozzles with a wiping unit, acquiring position information of the wiping unit, and ejecting ink from the nozzles according to the position of the wiping unit, wherein the ejecting of the ink is performed sequentially as the nozzles are wiped.

The nozzles may be arranged in rows parallel to the feeding direction of the printing medium, and the ejecting of the ink may be performed on a row-by-row basis.

The ejecting of the inks from a first row of nozzles may be performed before the ejection of the ink from a last row of nozzles.

The ejecting of the inks may not be performed simultaneously for all the nozzles.

The foregoing and/or other aspects and utilities of the present general inventive concept may be also achieved by providing a computer readable recording medium comprising computer readable codes to operatively control an image forming apparatus, including acquiring offset information of a plurality of print heads having a plurality of nozzles arranged in a widthwise direction perpendicular to a feeding direction of a printing medium, wiping a surface of the nozzles with a wiping unit, acquiring position information of the wiping unit, and ejecting ink from the nozzles according to the position of the wiping unit, wherein the ejecting of the ink is performed sequentially as the nozzles are wiped.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
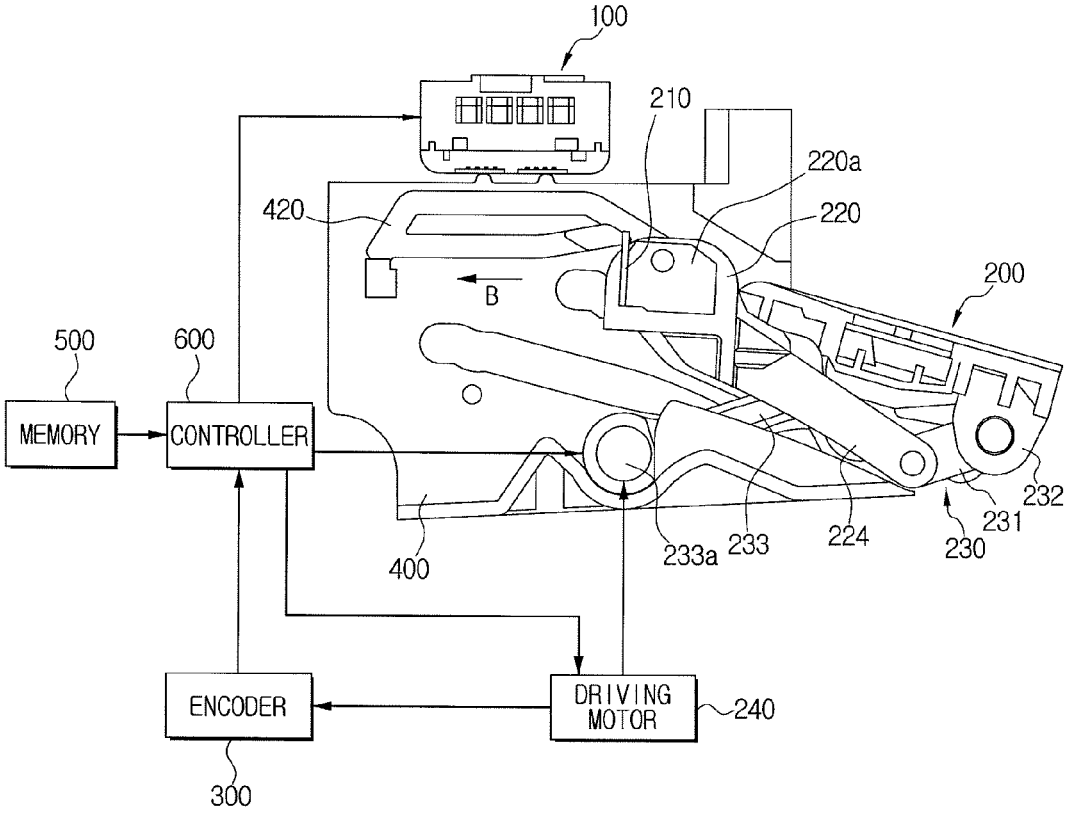
FIG. 1 is a schematic view illustrating a construction of an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic view illustrating an image forming apparatus according to an embodiment of the present general inventive concept. Referring to FIG. 1, the image forming apparatus may include an ink cartridge 100, a wiping unit 200, a positional information providing unit 300, a memory 500, and a controller 600.

The ink cartridge 100 maybe an array head type ink-jet printer ink cartridge having a plurality of print heads arranged to correspond with a width of a print medium, such as a paper. An example of such an array head type ink-jet printer ink cartridge 100 is described with reference to FIGS. 2 and 3.

Figure 2:
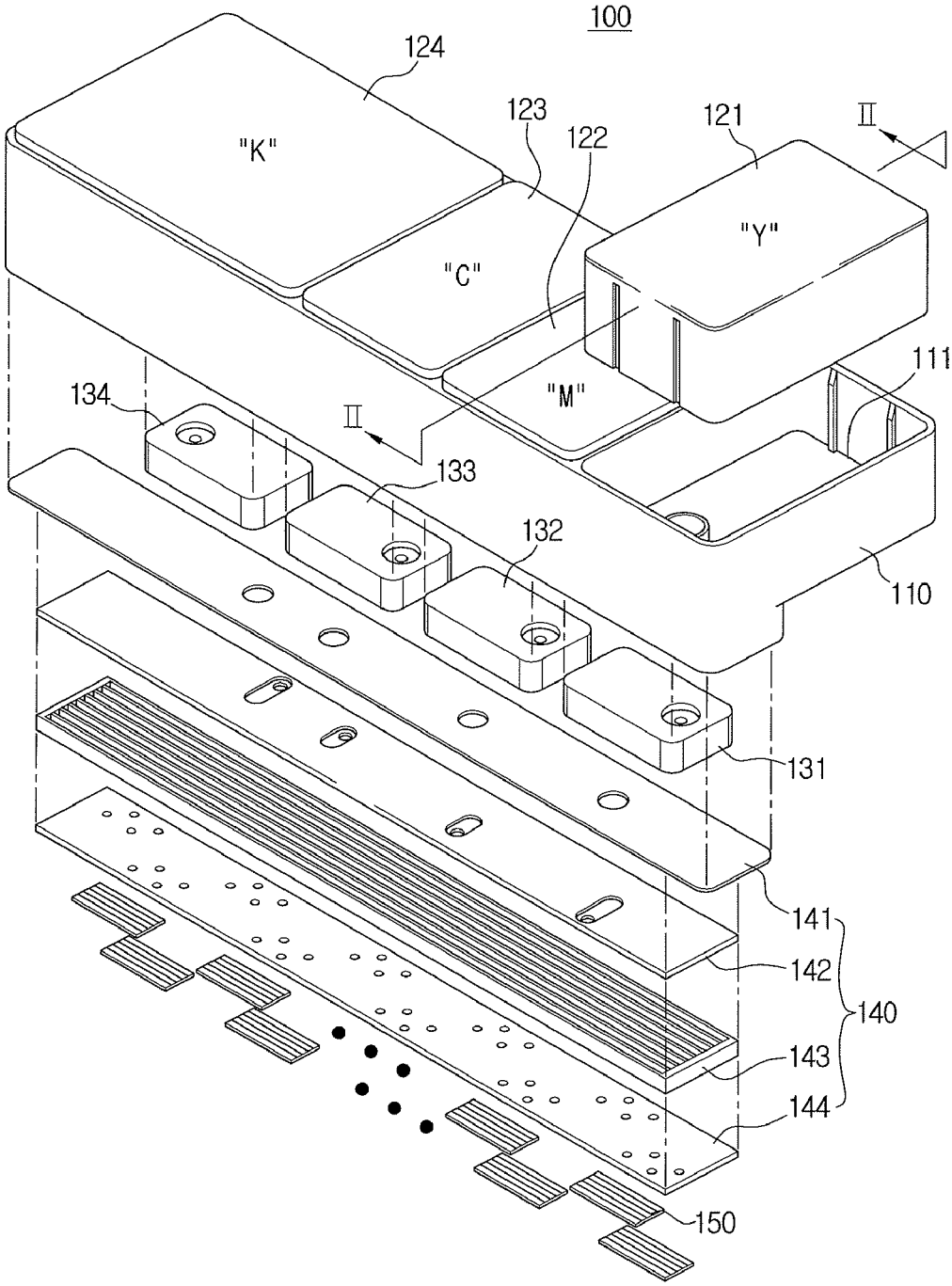
FIG. 2 is a schematic exploded perspective view illustrating ink cartridges of the image forming apparatus illustrated in FIG. 1.
Figure 3:
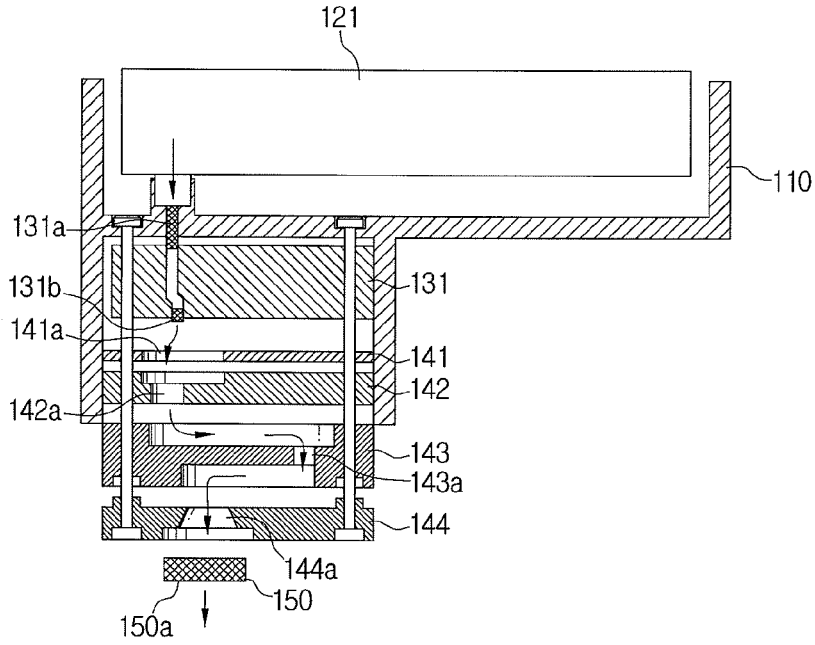
FIG. 3 is a cross-sectional view taken along line 11-11 of FIG. 2.

Referring to FIGS. 2 and 3, the ink cartridge 100 may include a plurality of ink tanks 121, 122, 123, and 124 to store inks, a plurality of negative pressure adjustment units 131, 132, 133, and 134 which are connected with the ink tanks 121,122,123, and 124, respectively, a plurality of print heads 150 arranged in a predetermined pattern in the widthwise direction of the print medium, and an ink channel unit 140 to supply inks to the print heads 150 from the ink tanks 121, 122,123, and 124.

The ink tanks 121, 122, 123, and 124 may be mounted in a frame 110. Such ink tanks 121, 122, 123, and 124 may contain various colors of inks, for example, yellow (Y), magenta (M), cyan (C) and black (B) inks, respectively.

The frame 110 may have a plurality of tank mounting parts 111, in which the ink tanks 121, 122, 123, and 124 are mounted, respectively.

The negative pressure adjustment units 131,132, 133, and 134 may be mounted on the underside of the frame 110 to communicate with the ink tanks 121,122, 123, and 124, respectively. For example, the negative pressure adjustment units 131 may communicate with the ink tank 121 and the ink channel unit 140 through an inlet 131*a* and an outlet 131*b*, respectively, as illustrated in FIG. 3. Such negative pressure adjustment units 131, 132, 133, and 134 produce a negative pressure so as to prevent the leakage of the inks.

The ink channel unit 140 is connected with the negative pressure adjustment units 131, 132, 133, and 134 and serves to supply inks, which are admitted into the ink channel unit 140 through the negative pressure adjustment units 131, 132, 133, and 134 from the ink tanks 121, 122, 123, and 124, to each of the print heads 150.

An example of such an ink channel unit 140 may include a plurality of channel plates 141, 142, 143, and 144, which are stacked and joined with each other. Among the channel plates 141, 142, 143, and 144, the channel plate 141 connected with the negative pressure adjustment units 131, 132, 133, and 134 may be a pressure plate. For example, the ink channel unit 140 may be formed by sequentially stacking three channel plates, i.e., a first channel plate 142, a second channel plate 143, and a third channel plate 144, as illustrated in the drawings. In addition, the pressure plate 141 may be omitted. Furthermore, the ink channel unit 140 may consist of two channel plates, or four or more channel plates.

The above-mentioned channel plates 141, 142, 143, and 143 may include channels 141*a*, 142*a*, 143*a*, and 144*a*, respectively, through which inks flow. The channels 141*a*, 142*a*, 143*a*, and 144*a* may be arranged in such a manner that each of them is communicated with one color ink.

Figure 4:
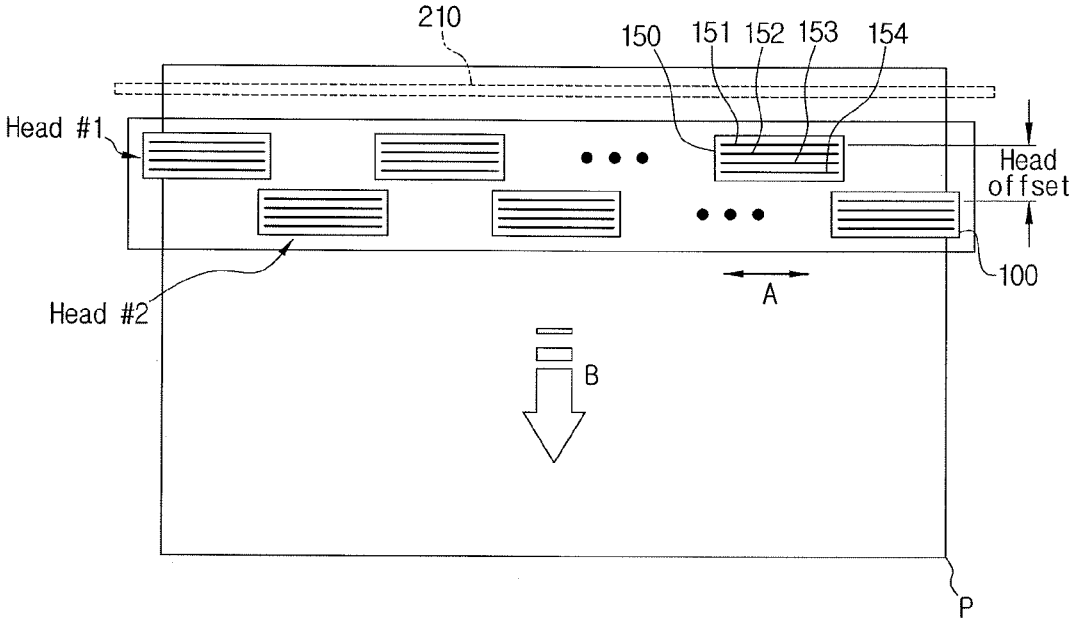
FIG. 4 is a view illustrating an arrangement of the print heads of the ink cartridges illustrated in FIG. 2.
Figure 7:
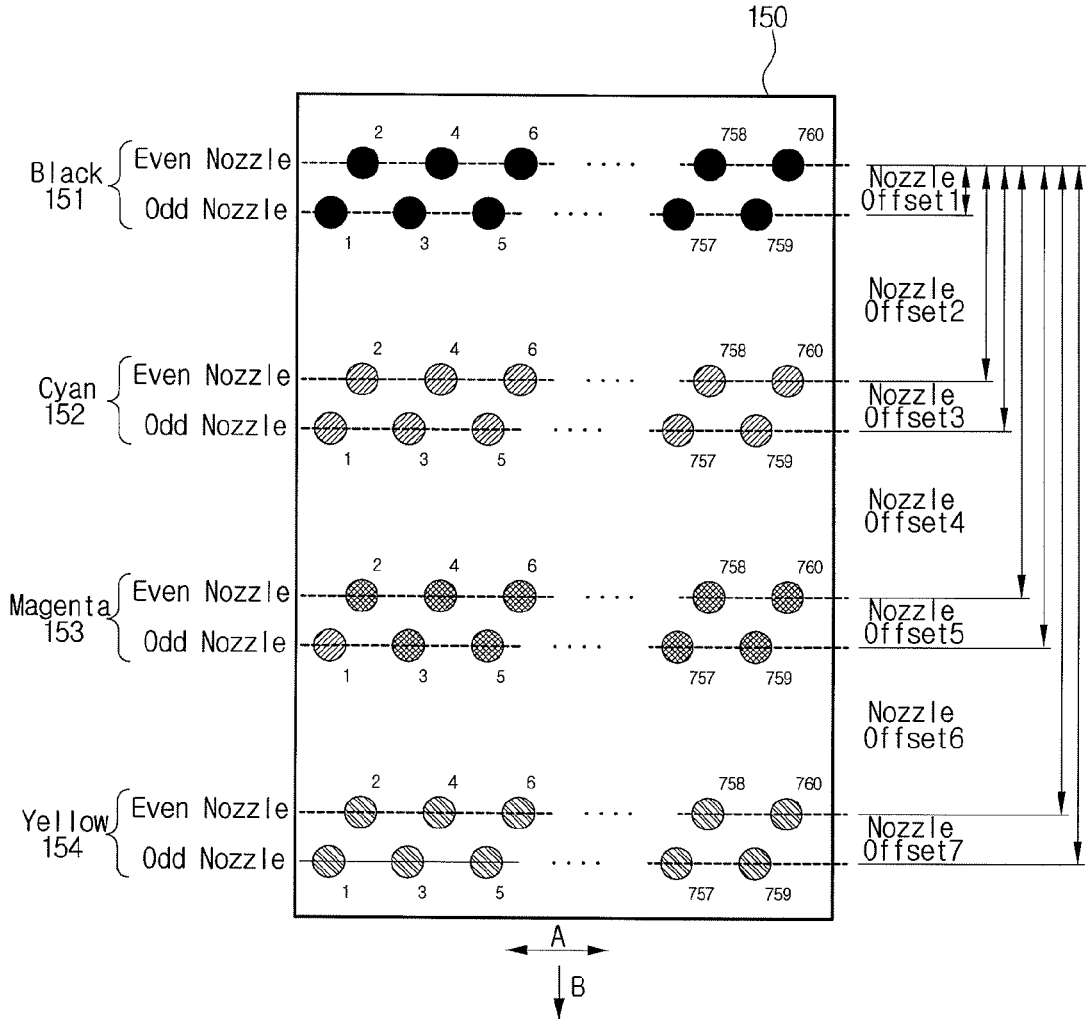
FIG. 7 is a view illustrating offsets of the print heads illustrated in FIG. 4.

Referring to FIG. 4, the print heads 150 can be classified and arranged in first and second rows of print heads Head #1 and Head #2, which are parallel to the widthwise direction of a paper P (hereinafter, the direction may be referred to as "A" direction) and spaced from each other in the paper feeding direction B (herein after, the direction may be referred to as "B" direction) (see FIG. 4). In addition, each of the print heads 150 may include a plurality of nozzles, wherein the nozzles can be color-specific nozzles 151, 152, 153, and 154 which are spaced from each other and eject different-color inks, respectively. The color-specific nozzles 151, 152, 153, and 154 are parallel to the "A" direction and may be arranged in rows, respectively. That is, as illustrated in FIG. 7, the color-specific nozzles 151, 152, 153, and 154 of K (Black), C (Cyan), M (Magenta) and Y (Yellow) colors are provided in such a manner as to be spaced in the "B" direction. In addition, the color-specific nozzles 151, 152, 153, and 154 may be arranged in two rows in the "B" direction, respectively, and the color nozzles in every two rows may alternately arranged in a zigzag pattern in the "A" direction. Therefore, if order numbers are assigned in the "A" direction for the color-specific nozzles 151, 152, 153, and 154, each two rows of nozzles may be classified into even nozzles and odd nozzles.

Each print head 150 may be provided with several hundreds of the above-mentioned color-specific nozzles 151, 152, 153, and 154, so that the nozzles can eject color-specific inks to desired positions on a paper during a printing operation, respectively.

Meanwhile, when inks are ejected from the nozzles, the inks ejected from the nozzles may be partially attached to and remain on the nozzle faces 150*a* of the print head 150 and also partially remain in the inlets of the nozzles (see FIG. 3). If the inks remaining on the nozzle surfaces or in the nozzle inlets are left as they are, they may pollute a paper fed for the next printing. In addition, if the inks are solidified, the nozzles may be blocked, whereby inks cannot be ejected through the nozzles. As a result, precision may be deteriorated in implementing normal colors of a picture or images at the time of next printing.

Accordingly, the print heads 150 can be operatively controlled by control signals from the controller 600 in such a manner that each of the nozzles 151, 152, 153, and 154 performs a so-called spitting operation to eject a predetermined quantity of ink periodically or whenever it is desired. Through the spitting operation, it is possible to prevent inks remaining on the respective nozzles 151, 152, 153, and 154 from being solidified to the extent that the nozzles are blocked by the inks. In addition, when the nozzle surfaces 150*a* are wiped by the wiping unit 200 to be described later, the inks pushed into the nozzles from the nozzle surfaces 150*a* by the wiping operation can be ejected through the spitting operation, whereby it is also possible to prevent the occurrence of color-mixing. The spitting operation and method will be described in more detail bellow.

The wiping unit 200 is employed so as to wipe ink attached to the nozzle surfaces 150*a* of the print heads 150 as described above. Referring to FIG. 1, the wiping unit 200 may include one or more blades 210, a frame 200 to support the blade 210, a driving unit 230 to move the frame 220, and a driving motor 240 to supply power to the driving unit 230.

Figure 5:
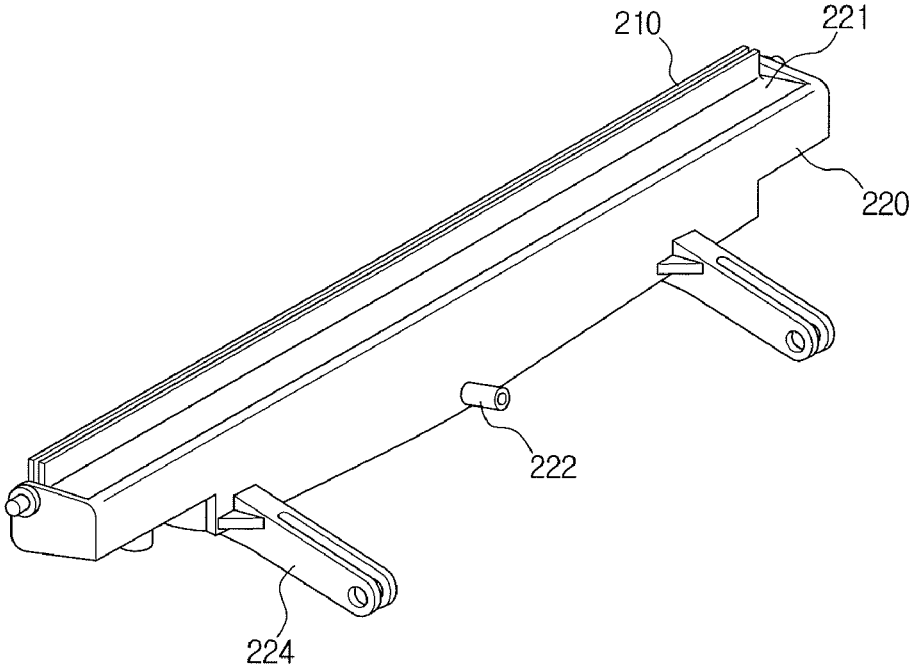
FIG. 5 is a perspective view illustrating a frame extracted from FIG. 1.

The blades 210 have a predetermined length in the widthwise direction of the paper (i.e., in the "A" direction) to extend across at right angles to the "B" direction as illustrated in FIG. 4, and may have a length sufficient to entirely wipe the print heads 150 by one reciprocating motion in the "B" direction. While FIG. 4 illustrates one blade 210, and FIG. 5 illustrates 2 blades 210, the present general inventive concept is not limited thereto, and different number of blades may be provided. The blades 210 can be flexibly deformed when they come into contact with the nozzle surfaces 150*a* of the print heads 150, so that they can be moved in a state in which they are in close contact with the nozzle surfaces over a predetermined area. For this purpose, the blades 200 may be formed from a rubber or a material in which a rubber material is mixed. In addition, the blades 210 can be supported at a side of the top of the frame 220 in an upright position.

The frame 220 is installed in such a manner as to reciprocate along a predetermined path while supporting the blade 210. As illustrated in FIG. 1, the frame 220 has a waste ink reservoir 220*a*, the top of which is opened. An absorbing member 221, such as a sponge, may be provided in the waste ink reservoir 220*a* (see FIG. 5). In addition, the blades 210 can be arranged along a longitudinal side of the waste ink reservoir 220*a*. For example, FIG. 5 illustrates an embodiment having a pair of blades 210 which are spaced from each other in parallel. The waste ink reservoir 220*a* receives waste ink ejected from the nozzles of the print heads 150. The waste ink collected in the waste ink reservoir 220*a* can be collected to a predetermined collection area through a discharge port 222 provided through the bottom wall of the frame 220.

In addition, the frame 220 may be connected to the driving unit 230 by a pair of connection members 224. One end of each of the connection members 224 can be rotatably connected to the driving unit 230. Such a frame 220 can be co-operated with the driving unit 230, such that, when the driving unit 230 is operated, the frame 220 is thereby being moved along a predetermined path, so that the nozzle surfaces 150*a* of the print heads 150 can be wiped by the blades 210. In addition, after the wiping operation, the frame 150 can be moved in the direction away from the print heads 150 so that the blades 210 are spaced from the nozzle surfaces 150*a*, thereby being positioned in a standby condition or returned to its original position.

The driving unit 230 serves to move the frame 220, an example of which is illustrated in FIG. 1. That is, the driving unit 230 may include a torsion bar 231, to which the connection members 224 are connected, a platen 232 rotatably connected to the torsion bar 231, and a swivel lever 233 to swivel the platen 232.

Figure 6A:
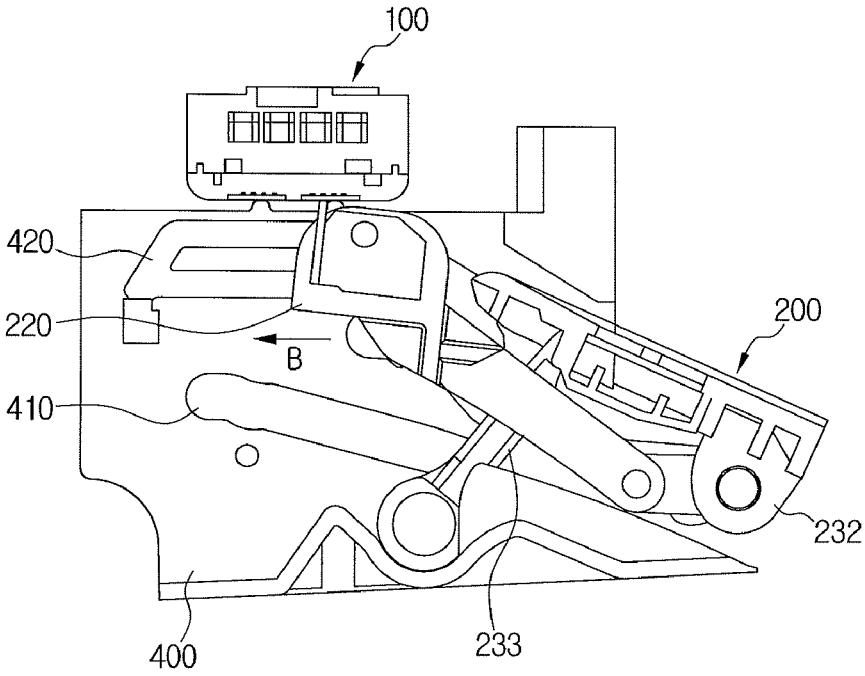
FIGS. 6A to 6C are views illustrating an operation of a frame illustrated in FIG. 1.
Figure 6B:
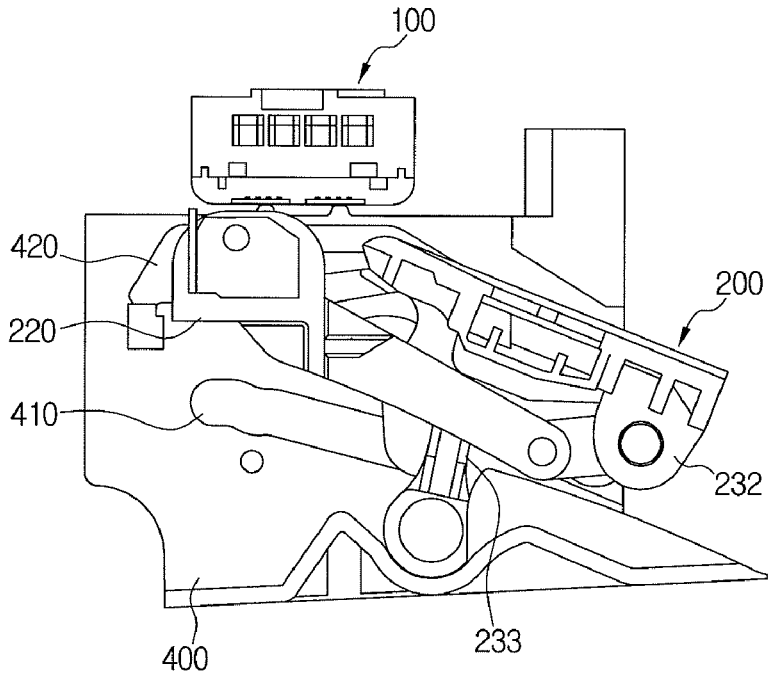

The swivel lever 233 is rotatably connected to a main body 400 of the image forming apparatus at one end thereof and co-operatively connected to the platen 232 at the other end. Because a driving motor 240 can be connected to the swivel lever 233, the power of the driving motor 240 can be transferred to the swivel lever 233. The swivel lever 233 is capable of being reciprocally swiveled depending on the rotating direction of the driving motor 240. With the driving unit 230 configured as described above, if the driving motor 240 is operatively controlled by the controller 600, the swivel lever 233 is swiveled. As illustrated in FIGS. 6A and 6B, the platen 232 is moved toward the bottom side of the ink cartridge 100 while being guided along a cam slot 410. At the same time, the frame 220 connected to the connection members 224 is also moved toward the bottom side of the ink cartridge 100 while being guided along a cam slot 420 provided in the main body 400. With this movement, the blades 210 supported by the frame 220 wipe the nozzle surfaces 150*a* of the print heads 150.

Figure 6C:
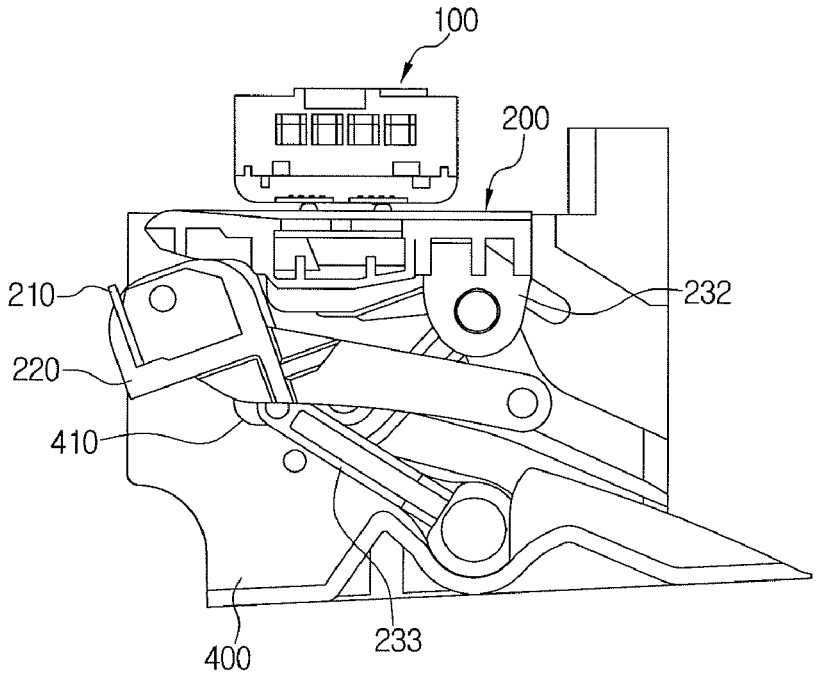

After finishing the wiping operation, as illustrated in FIG. 6C, the blades 210 may stand by at a position spaced from the ink cartridge 100 and the platen 232 can be positioned under the ink cartridge 100.

Although the driving unit 230 is briefly described herein, it is possible to modify the driving unit 230 in various ways within the present general inventive concept. Therefore, a more detailed illustration and description of the driving unit 230 are omitted for clarity and conciseness. That is, it shall be appreciated that the driving unit 230 can be readily embodied within the present general inventive concept if it has a structure to move the frame 220 so as to allow the blades 210 supported by the frame 220 to wipe the nozzle surfaces 150*a* of the print heads 150, and one skilled in the art can readily implement the driving unit 230 by using known techniques. In addition, it shall not be considered that the scope of the present general inventive concept is limited by the construction of the driving unit 230 described here.

The driving motor can be a DC motor which is bi-directionally rotatable and the rotating velocity of which is controllable.

An encoder 300 may serve as the positional information providing unit 300, and can be connected to the driving motor 240 so as to provide a count value according to the rotational driving of the driving motor for the controller 600.

The memory 500 is stored with offset information of the print heads 150 as illustrated in FIGS. 4 and 7. The offset information includes head offsets between the print heads Head #1 and Head #2 of the first and second rows which are spaced from each other in the "B" direction, and nozzle offsets for the respective nozzles in the "B" direction from the respective print heads 150.

As illustrated in FIG. 7, the nozzle offsets can be set by classifying the color-specific nozzles 151, 152, 153, and 154 into even nozzles and odd nozzles with reference to the even nozzles of K color nozzles 151 in terms of the "B" direction.

The controller 600 operatively controls the print heads 150 of the ink cartridge 100 in an individual manner. More particularly, the controller 600 individually drives each of the nozzles one by one, so that each of the nozzles can independently eject ink. In addition, the controller 600 controls the driving of the driving motor 240 of the wiping unit 200, thereby controlling the wiping operation of the blades 210.

Figure 8:
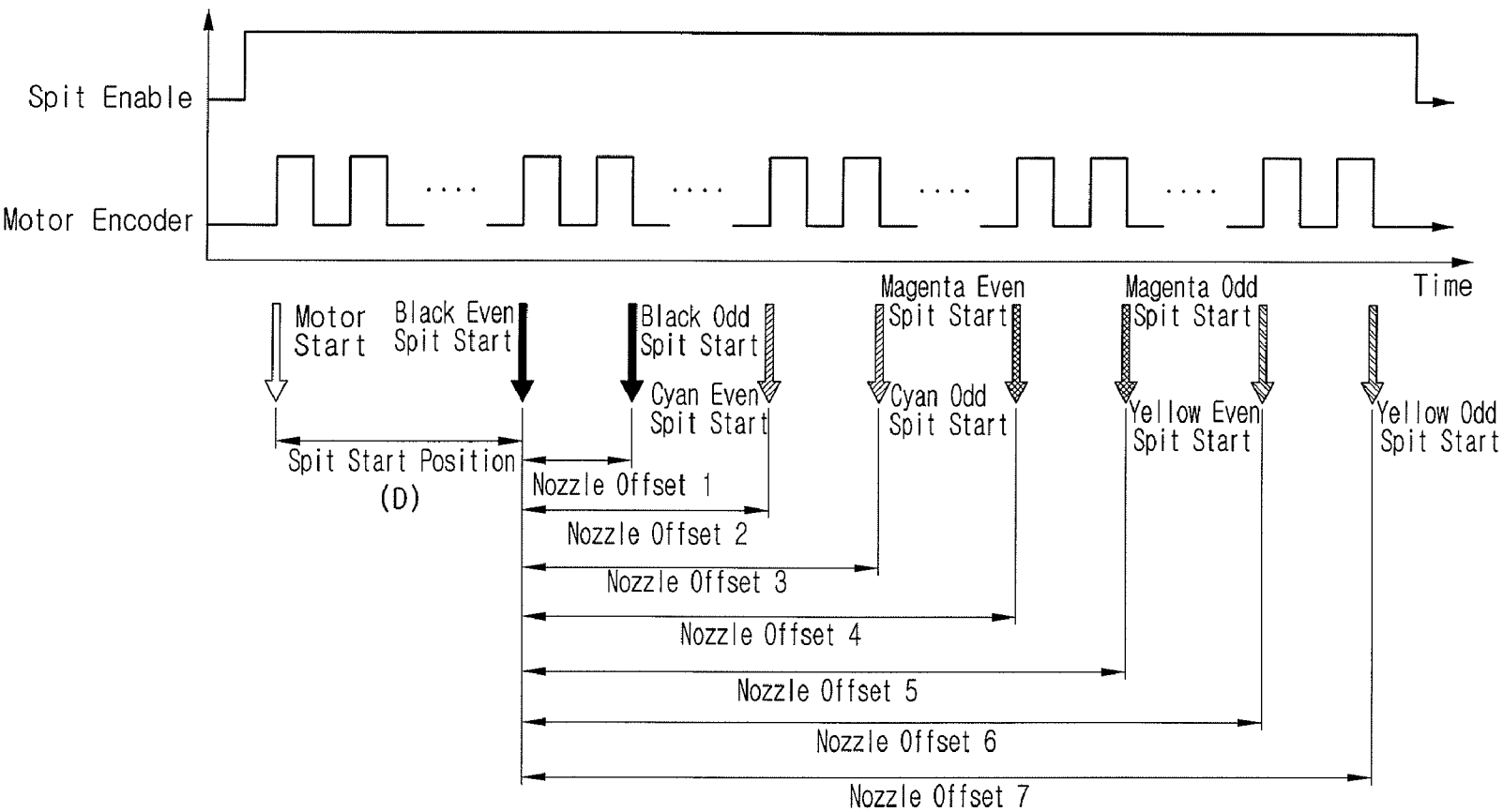
FIG. 8 is a timing graph illustrating timing of a spitting operation after wiping with an image forming apparatus according to an embodiment of the present general inventive concept.

In addition, the controller 600 can estimate the positions of the blades 210 by converting the count information of the driving motor transferred from the encoder 300. That is, by converting the information counted by the encoder 300 from the beginning of the driving of the driving motor 240 into a moved distance of the blades 210, it is possible to estimate the positions of the blade 210. As a result, the controller 600 can estimate the wiping timing for each nozzle of each print head 150 on the basis of the offset information, as well as the wiping timing of each print head 150 while the wiping operation is performed by the blades 210. That is, as illustrated in FIG. 8, the interval from a time point the driving of the driving motor 240 is initiated to move the blades 210 to a time point just after the blades 210 wipe the even nozzles of the K nozzles 151 can be referred to as a spitting timing D, and the spitting timing can be estimated from a time point the spitting operation is initiated from the even nozzles of the K nozzles 151 on the basis of the nozzle offset information stored in the memory 500 and the count information of the encoder 300.

Like this, the controller 600 can operatively control the print heads by determining a spitting timing for each of the even nozzles and odd nozzles of the nozzles 151, 152, 153, and 154 of each of the print head 150 on the basis of the wiping timing estimated for each nozzle.

Hereinbelow, a method to operatively control the image forming apparatus configured according to the above-mentioned embodiment of the present general inventive concept is described in more detail.

Figure 9:
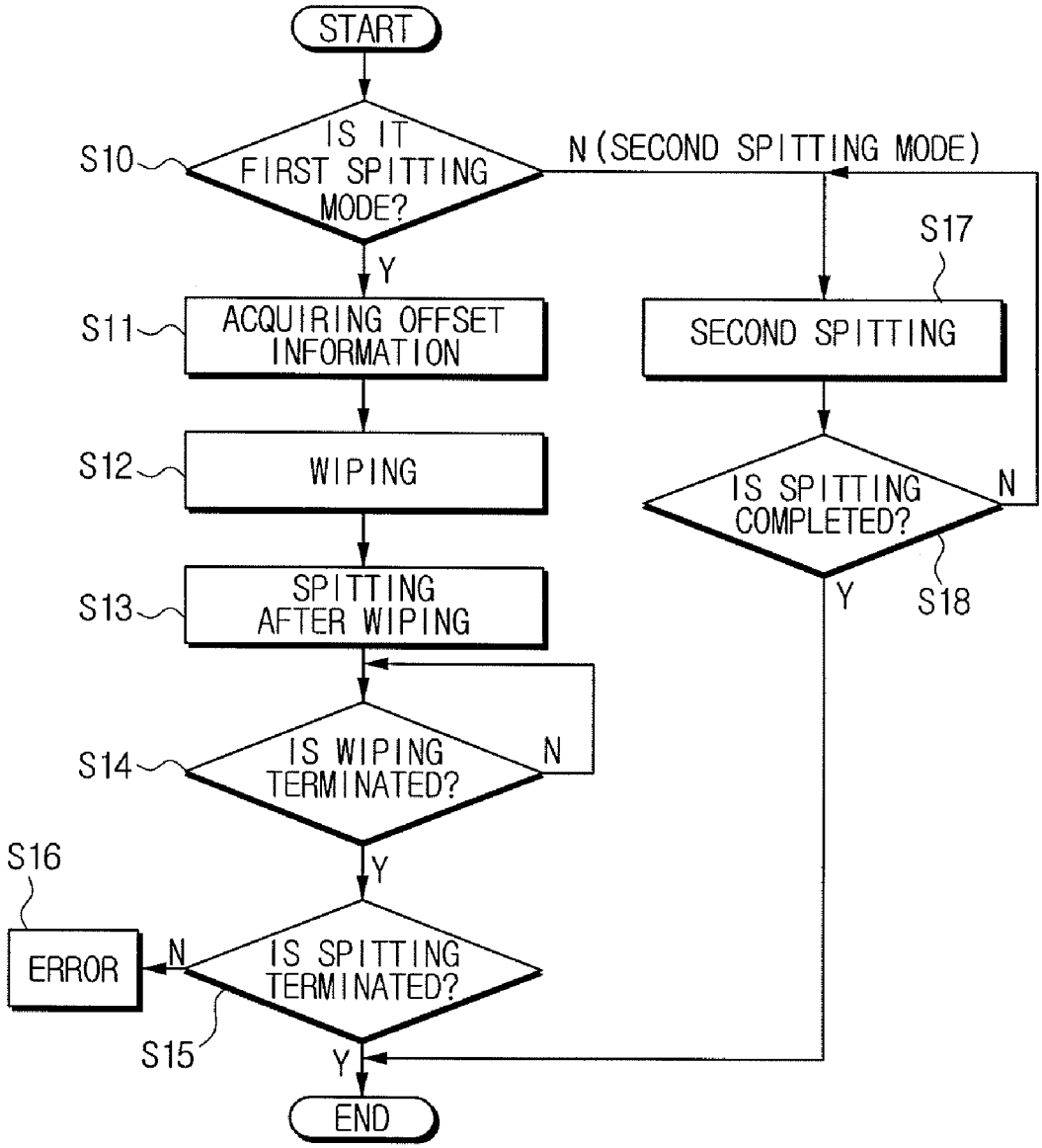
FIG. 9 is a flowchart illustrating a method for operatively controlling an image forming apparatus according to an embodiment of the present general inventive concept.

As illustrated in FIG. 9, when spitting is required during the printing, the controller 600 determines whether it corresponds to a first spitting mode or a second spitting mode (S10). Here, the first spitting mode is a mode in which the spitting operation is performed for each of heads or nozzles of the print heads 150 just after corresponding head or nozzle is wiped. The second spitting mode is a spitting mode in which the spitting operation is performed without a wiping operation.

The first spitting mode can be set in such a manner as to be performed at the time of completing a print operation or when it is desired to perform a print operation in a state in which a print operation has not been performed for a reference period of time.

If the spitting mode is determined as the first spitting mode, the controller 600 acquires the offset information stored in the memory 500 (S11). As described above with reference to FIGS. 4 and 7, the offset information is classified into head offsets, each of which is specific for one of the print heads 150 and nozzle offsets, each of which is specific for one of nozzles of each of the print heads 150. The nozzle offsets include nozzle offset 1 to nozzle offset 7 from the odd nozzles of the K color nozzles 151 as illustrated in FIG. 7.

Next, the controller 600 operatively controls the driving motor 240 so as to drive the wiping unit 200, so that the wiping operation is performed (S12). At the time of wiping operation, the blades 210 simultaneously wipe nozzles arranged in a line in the "A" direction while moving in the "B" direction as illustrated in FIGS. 1, 4, 6A, 6B and 6C.

Just after wiping the nozzles arranged in the "A" direction as described above, the controller 600 individually controls each nozzle of each print head 150 so that each wiped nozzle ejects ink in a predetermined direction, thereby performing the spitting operation (S13).

Figure 10:
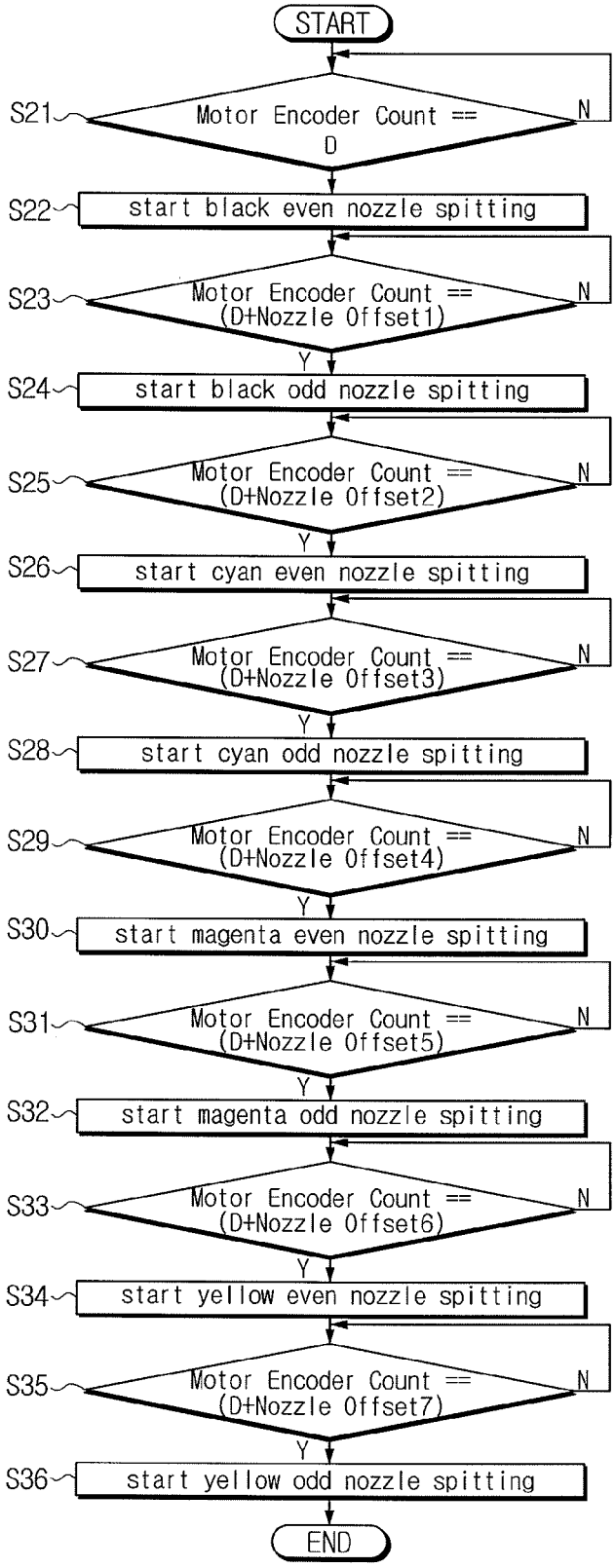
FIG. 10 is a flowchart illustrating a spitting operation performed after wiping in the flowchart of FIG. 9.

The operation S13 is described in more detail with reference to FIG. 10.

When the wiping operation is initiated, the controller 600 converts a count value transferred from the encoder 300 so as to determine whether the blades 210 are at the spitting-initiation position D (S21). If the blades 210 are at the spitting-initiation position D, the controller 600 determines that it is just after the even nozzles of the K color nozzles 151 have been wiped, and operatively controls the even nozzles of the K color nozzles 151 to perform the spitting operation (S22).

Next, if the distance determined by converting the count value transferred from the encoder 300 equals the sum of the spitting-initiation position D and the nozzle offset 1 (S23), the controller 600 operatively controls the odd nozzles of the K color nozzles 151 to perform the spitting operation S24.

With the above-mentioned method, the positions of the blades 210 are estimated through the operations (S25, S27, S29, S31, S33, S35) to determine the positions of the blades 210, and the spitting operation of each nozzle is performed through each of the operations (S25, S27, S29, S31, S33, S35) on the basis of the positional information and offset information estimated for the blades 210.

In addition, by using the head offset information between the print heads Head #1 and Head #2 of the first and second rows, it is possible to control the print heads in such a manner that each of the print heads Head #1 and Head #2 in each row performs the spitting operation after the wiping operation. Furthermore, as described above, each of the print heads Head #1 and Head #2 in each row can perform the spitting operation just after the wiping operation through the above-mentioned operations (S21 to S36).

Referring to FIG. 9 again, after the wiping and spitting operations are sequentially performed for each nozzle, the controller 600 checks whether the wiping operation is completed (S15) and then checks whether the spitting operation is completed (S15).

If the spitting operation is not completed in the checking operation S15, it is possible to determine a cause of an error (S16) and process the cause of the error through A/S or the like.

In addition, in the operation S10, if it is determined that the mode is not the first spitting mode but the second spitting mode, the controller 600 omits the wiping operation and operatively controls only the print heads 150 (S17), and then if it is confirmed that the spitting operation is completed (S18), the controller 600 terminates the spitting mode.

Figure 11A:
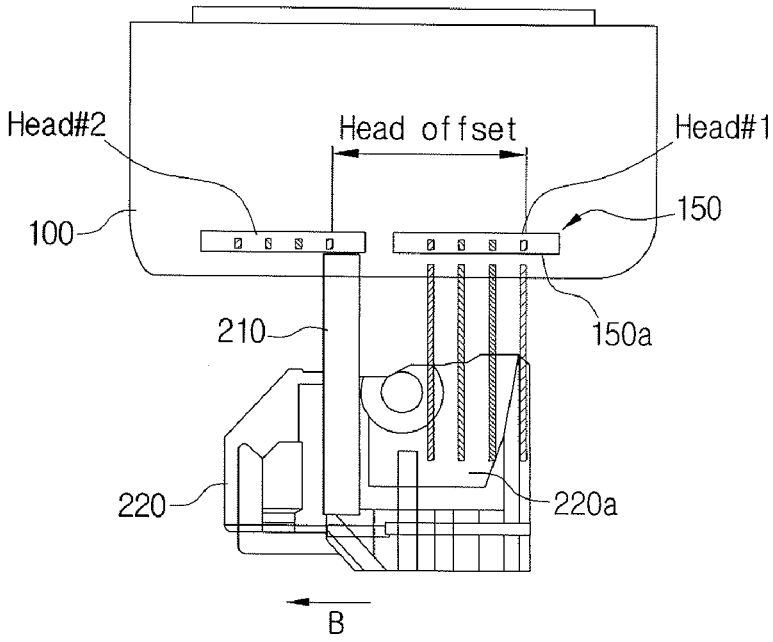
FIGS. 11A and 11B are views illustrating a method of driving an image forming apparatus according to another embodiment of the present general inventive concept.
Figure 11B:
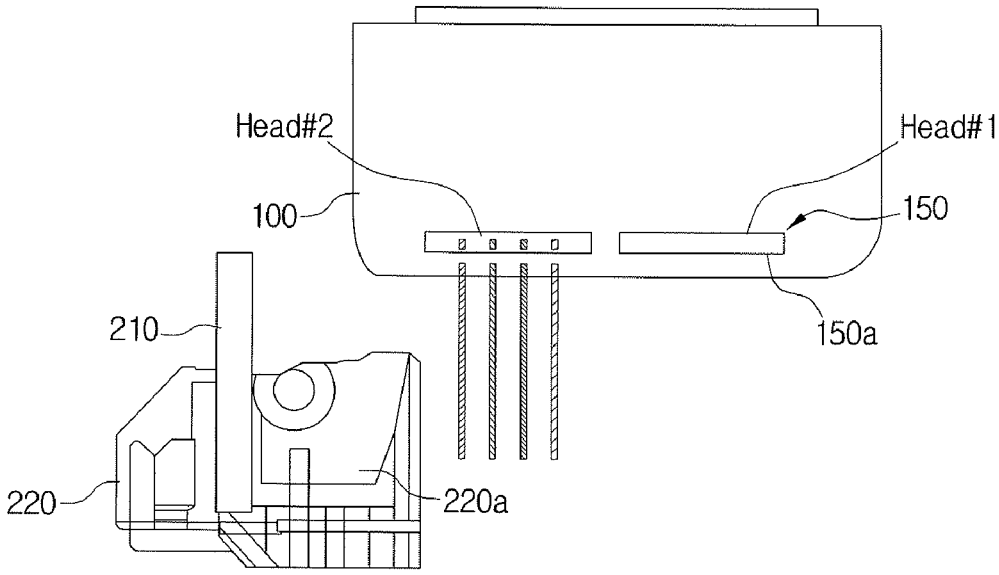

FIGS. 11A and 11B are views illustrating how the wiping and spitting operations are performed by the method of operatively controlling the image forming apparatus according to the above-mentioned embodiment of the present general inventive concept.

Here, the moving conditions of the frame 220 and the blades 210 are mainly described.

As illustrated in FIG. 11A, if the blades 210 move in the "B" direction, the nozzle surfaces 150*a* of the print heads Head #1 of the first row are firstly wiped. After all the nozzles 150*a* of the print heads Head #1 of the first row are wiped, the controller 600 determines that all the nozzle surfaces 150*a* of the print heads Head #1 of the first row are wiped by the blades 210 and then immediately operatively controls the print heads Head #1 of the first row, so that all the nozzles simultaneously eject a predetermined amount of color-mixed ink, whereby the spitting operation is performed.

Here, at the time of the wiping operation, an ink of a certain color on the nozzle surface 150*a* is pushed into a nozzle of another color by the ink blades 210, thereby causing counter-diffusion or color mixed. The color-mixed ink, which is counter-diffused by being pushed into a nozzle, is all ejected because the spitting operation is performed just after the wiping operation is completed. The ejected color-mixed ink is received by the waste ink reservoir 220*a* of the frame 220.

Thereafter, the blades 210 continue to move in the "B" direction and wipe the nozzle surfaces 150*a* of the print heads Head #2 of the second row. Just after the wiping operation for the print heads Head #2 of the second row is completed, the controller simultaneously operatively controls the print heads Head #2 on the basis of the head offset information in the same manner as described above, so that color-mixed ink is simultaneously ejected from all the nozzles of the print heads Head #2 of the second row, thereby performing the spitting operation.

As described above, in the arrangement pattern of print heads 150 arranged in a plurality rows in the "B" direction, the driving of the print heads Head #1 and Head #2 is controlled in such a manner that each of the print heads in each row performs the spitting operation, wherein the spitting operation can be performed just after the wiping operation by using the offset information and the encoder count information. As a result, the length of time required for the wiping and spitting operations can be reduced. In conventional image forming apparatus, all the print heads are wiped and then the spitting operation is simultaneously performed for all the print heads. However, according to the present general inventive concept, the length of time required for the wiping and spitting operations can be reduced and the amount of color-mixed ink in each of the nozzles can be also reduced as compared with the existing image forming apparatus. That is, because the ink, which has been already wiped and pushed into the nozzles of the print heads #1 of the first row, is counter-diffused while the print heads Head #2 of the second row is wiped, the amount of color-mixed ink is increased, as a result of which the amount of color-mixed ink to be wasted through ejection is also increased. Therefore, because it is possible to minimize the amount of color-mixed ink in the nozzles and to reduce the amount of ink to be wasted through ejection by controlling the print heads in such a manner that the spitting operation is sequentially performed according to the wiped order of the print heads as in the present general inventive concept, ink can be saved. In particular, because the difference between the wiping-completion time and the spitting-initiation time can be minimized according to the present general inventive concept, the length of time required for the wiping and spitting operations can be reduced and the color-mixed amount of inks can be minimized, as a result of which there is an advantage of reducing the spitting amount of ink.

In addition, if a large amount of ink is ejected, there is problem in that peripheral products may be polluted due to fog produced during the ejection. However, according to the present general inventive concept, there is an advantage in that the occurrence of fog can be inhibited because the amount of ink ejected at the time of spitting can be reduced.

A method to operatively control an image forming apparatus according to another embodiment of the present general inventive concept is described with reference to FIGS. 12A to 12D. In this case, the spiting operation is also performed after the wiping operation. However, the spitting operation is sequentially executed alternating with the wiping sequence of the color-specific nozzles 151, 152, 153, and 154 of each of the print heads 150, and in particular, the operatively control is performed in such a manner that the spitting operation is individually performed for each nozzle just after the wiping operation.

Figure 12A:
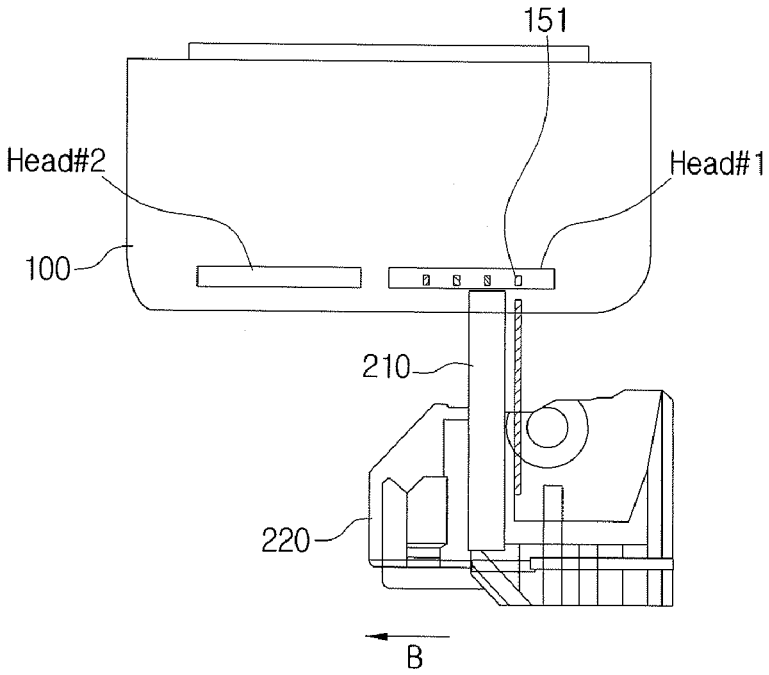
FIGS. 12A to 12D are views illustrating a method of operatively controlling an image forming apparatus according to another embodiment of the present general inventive concept.

That is, the blades 210 first wipe the nozzle surfaces 150*a* of the print heads Head #1 of the first row while moving in the "B" direction. For example, just after the blades 210 wipe the even nozzles of the first K color nozzles 151 among the nozzles 151, 152, 153, and 154 of four colors, the spitting operation is performed for the even nozzles of the wiped K color nozzles 151. Next, just after the odd nozzles of the K color nozzles 151 are wiped, the spitting operation is continuously executed, whereby the wiping and spitting operations of the K color nozzles 151 are completed. FIG. 12A illustrates the condition of performing the spitting operation after the odd nozzles of the K color nozzles 151 are wiped for the convenience of explanation.

Figure 12B:
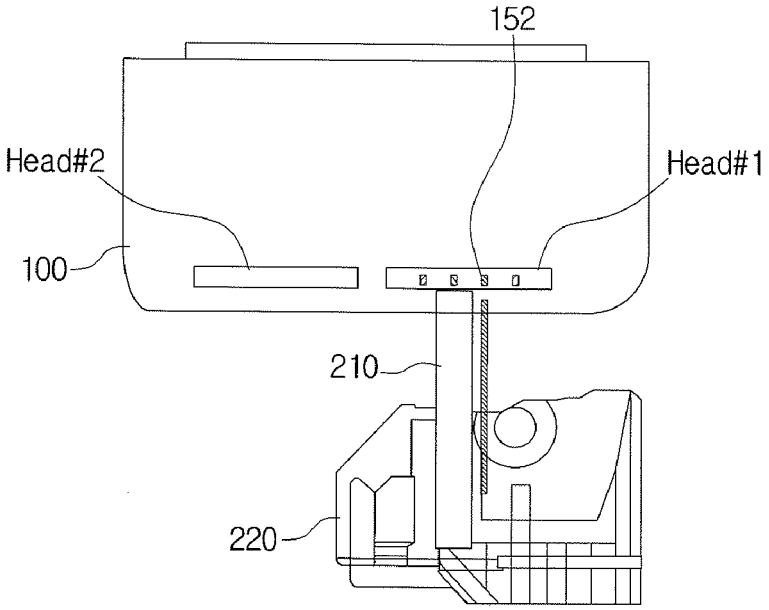
Figure 12C:
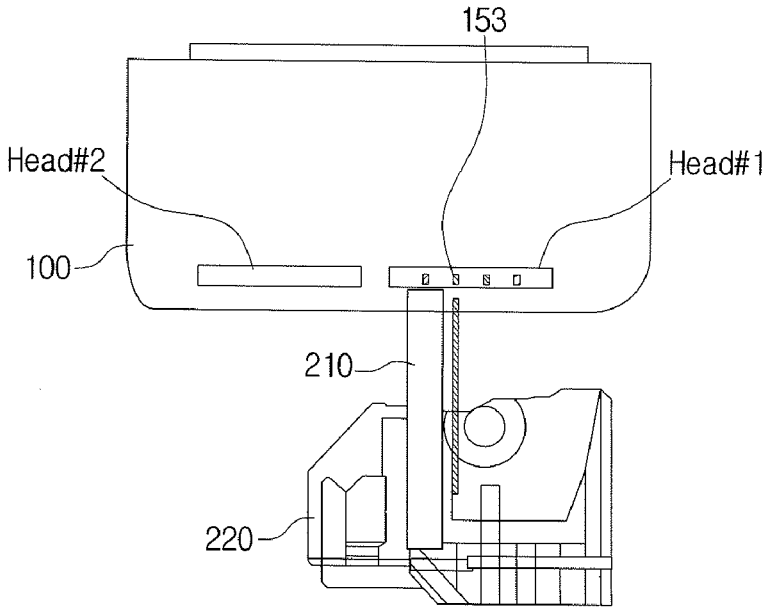
Figure 12D:
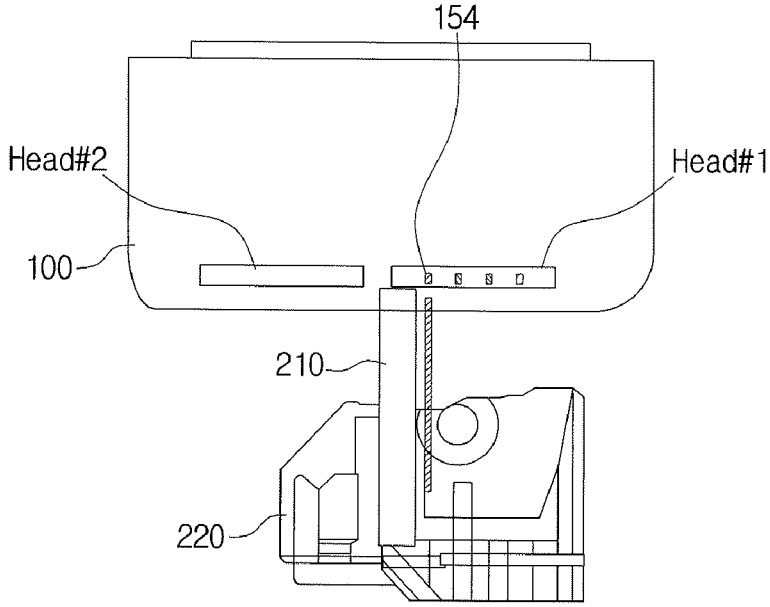

Next, the even nozzles and odd nozzles of each of the color-specific nozzles 152, 153, and 154 sequentially perform the spitting operation in the sequence illustrated in FIGS. 12B, 12C and 12D just after they are wiped. Then, the nozzle surfaces 150*a* of the print heads Head #2 of the second row are wiped and the spitting operation is performed, during which each of the nozzles sequentially ejects ink in the wiped sequence.

If the spitting operation is sequentially performed just after the wiping is performed on a color-specific nozzle basis or on an individual nozzle basis for the color-specific nozzles 151, 152, 153, and 154, the length of time required for the wiping and spitting operations can be reduced. In addition, because the spitting operation is controlled to be performed on a color-specific nozzle basis just after wiping, the ink pushed into the nozzles at the time of wiping can be more efficiently prevented from being counter-diffused within the nozzles.

In addition, because the spitting operation is quickly executed, it is possible to reduce the color-mixed amount caused by the counter-diffusion in the wiped nozzles. Furthermore, because color-mixed ink is quickly ejected before the color-mixed amount by the counter-diffusion is increased, the amount of color-mixed ink to be ejected at the time of spitting can be reduced. Therefore, there is an advantage of reducing the waste of ink.

In addition, the spitting operation can be performed on a print head basis for the print heads 150 arranged in the "B" direction, or on a color-specific nozzle basis as well as on an individual nozzle basis, and the spitting velocity can be controlled in proportion to the wiping velocity by the controller 600.

Various embodiments of the present general inventive concept can be embodied as computer readable codes on a computer readable recording medium. The computer readable recording medium may include any data storage device suitable to store data that can be thereafter read by a computer system. Examples of the computer readable recording medium include, but are not limited to, a read-only memory (ROM), a random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Various embodiments of the present general inventive concept may also be embodied in hardware or in a combination of hardware and software.

As described above, according to the present general inventive concept, in the image forming apparatus and the drive control method thereof, by moving a blade in a paper feeding direction and simultaneously wiping a plurality of print heads arranged in an array type, the length of time required to wipe can be reduced.

In addition, by controlling the spitting operation to eject ink pushed into nozzles by the blade and counter-diffused in the nozzles in such a manner that the spitting operation are performed on a print head basis or on a nozzle basis for the print heads sequentially arranged in the paper feeding direction, the amount of color-mixed ink in each nozzle can be reduced.

In particular, by estimating the position of the blade and controlling the spitting operation in such a manner that the spitting operation can be performed just after the wiping operation is completed for each nozzle, the length of time required for the wiping and spitting operations can be reduced to that extent.

Because the spitting operation can be performed quickly before the amount of counter-diffused ink is increased, the amount of color-mixed ink to be ejected can be reduced. Therefore, because the amount of ink ejected at the time of spitting, the consumption of ink can be reduced.

Moreover, because the amount of ejected ink, the occurrence of fog caused by the ejection of ink can be minimized, thereby minimizing the pollution caused by the fog.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An image forming apparatus, comprising:

an ink cartridge having a plurality of print heads arranged in a widthwise direction of a print medium;

a wiping unit to wipe the print heads while moving in the print medium feeding direction;

a positional information providing unit to provide positional information about a relative position of the wiping unit in relation to the nozzles of the print heads when the wiping unit is operated; and a controller to operatively control the print heads in such a manner that on the basis of the positional information provided from the positional information providing unit and offset information of the ink cartridge, the controller estimates a wiping timing to wipe the nozzles of the print heads with the wiping unit and determines a spitting timing to eject a predetermined amount of ink in the wiped sequence of the nozzles, whereby the controller controls the nozzles to eject ink sequentially as the nozzles are wiped by the wiping unit.

2. The image forming apparatus of claim 1, wherein the print heads are arranged in first and second rows so that the print heads are parallel to the widthwise direction and spaced from each other in the print medium feeding direction, and the wiping unit firstly wipes the print heads of the first row and then wipes the print heads of the second row.

3. The image forming apparatus of claim 2, wherein the offset information comprises:

head offsets of the print heads in relation to the medium feeding direction, each head offset corresponding to one of the print heads; and nozzle offsets of each of the print heads in the medium feeding direction.

4. The image forming apparatus of claim 3, wherein on the basis of the head offset information of the first and second rows and the positional information of the wiping unit, the controller determines the spitting timing at the time of completing the wiping operation of the first row and controls the spitting operation to be performed at the determined spitting timing.

5. The image forming apparatus of claim 3, wherein on the basis of the nozzle offset information of the print heads of each of the rows and the positional information of the wiping unit, the controller controls each of the nozzles of each of the print heads to perform the spitting operation at the time the wiping operation is completed for the corresponding nozzle.

6. The image forming apparatus of claim 1, wherein the wiping unit comprises:

a plurality of blades arranged in the widthwise direction to be parallel to each other to wipe the print heads;

a frame to support the plurality of blades and having a reservoir to receive the ink ejected from wiped print heads;

a driving unit to drive the frame in such a manner as to reciprocate along a predetermined path so that the nozzle surfaces of the print heads are wiped by the blades; and a driving motor to provide the driving unit with a power.

7. The image forming apparatus of claim 6, wherein the plurality of blades comprises a pair of the blades which are arranged parallel to each other in the widthwise direction.

8. The image forming apparatus of claim 6, wherein the positional information providing unit comprises an encoder connected to the driving motor.

9. The image forming apparatus of claim 1, wherein the positional information providing unit comprises an encoder connected to a driving motor to provide a power to drive the wiping unit.

10. The image forming apparatus of claim 1, wherein the offset information of the ink cartridge is previously set and stored in a memory.

11. The image forming apparatus of claim 1, wherein the offset information comprises:

head offsets of the print heads in relation to the printing medium feeding direction, each offset corresponding to one of the print heads; and nozzle offsets for each of the print heads in relation to the printing medium feeding direction.

12. The image forming apparatus of claim 11, wherein the controller controls each of the print heads in such a manner that on the basis of the head offset and nozzle offset information and the positional information, the controller estimates the wiping completion timing for each of the nozzles of each of the print heads in relation to the print medium feeding direction and renders the corresponding nozzle to perform the spitting operation at the wiping completion timing.

13. A method to operatively control an image forming apparatus, comprising:

acquiring offset information for a plurality of print heads arranged in a widthwise direction;

moving one or more blades so as to wipe a plurality of nozzles of the print heads arranged in the widthwise direction with the blades;

acquiring positional information of the blades;

estimating wiping timing for the print heads on the basis of the acquired positional information and offset information;

determining spitting timing to eject ink so as to remove admitted into the nozzles of wiped print heads on the basis of the estimated wiping timing; and ejecting ink from the nozzles of corresponding print heads sequentially as the nozzles are wiped.

14. The method of claim 13, wherein the offset information comprises:

head offsets for the print heads in relation to the printing medium feeding direction, each head offset corresponding one of the print heads; and nozzle offsets of each of the print heads in the print medium feeding direction.

15. The method of claim 13, wherein the moving of the one or more blades comprises:

arranging the blades having a length corresponding to the width of the print medium; and moving the blades in the print medium feeding direction.

16. The method of claim 13, wherein the acquiring of the positional information comprises:

rotationally driving the driving motor to move the blades; and calculating the moving distance of the blades from the initial positions thereof on the basis of a count value of an encoder connected to the driving motor.

17. The method of claim 13, wherein the obtaining of the spitting timing comprises determining the spitting timing in such a manner as to be performed for each of the nozzles in the sequence of the wiped nozzles just after so that the spitting timing corresponds to the sequential completion of the wiping of the nozzles of each of the print heads in the print medium feeding direction.

18. An image forming apparatus, comprising a plurality of print heads to eject ink on a printing medium, the print heads arranged widthwise with respect to a feeding direction of the printing medium and each having a plurality of nozzles;

a wiping unit to wipe the print heads;

a position unit to provide position information of the wiping unit with respect to the print heads; and a controller to control the print heads to eject ink according to the provided position information of the wiping unit sequentially as the print heads are wiped by the wiping unit.

19. The image forming apparatus of claim 18, wherein the controller determines a wiping timing to wipe the nozzles of the print heads and determines an ejection timing to eject a predetermined amount of ink from the wiped nozzles of the print heads.

20. The image forming apparatus of claim 19, wherein the controller controls the nozzles to eject the ink as they are sequentially wiped.

21. The image forming apparatus of claim 19, wherein the controller uses offset information of the nozzles of the print heads to determine the ejection and wiping timing.

22. The image forming apparatus of claim 20, wherein the nozzles are arranged in rows parallel to the feeding direction of the printing medium, and the controller controls the nozzles to eject the ink as they are sequentially wiped on a row-by-row basis.

23. An array-type inkjet printer, comprising:

a plurality of nozzles arranged in a widthwise alignment perpendicular to a feeding direction of a printing medium;

a wiping unit to wipe a surface of the nozzles;

a controlling unit to control the wiping unit and the nozzles to eject a predetermined amount of ink in a spitting operation, wherein the controller controls the nozzles to eject ink sequentially as the nozzles are wiped by the wiping unit.

24. The array-type inkjet printer of claim 23, wherein the nozzles are arranged in sequential rows of different inks and the controller controls the wiping unit to wipe the nozzles on a row-by-row basis.

25. An image forming apparatus, comprising:

a print head having first nozzles and second nozzles disposed on a first row and a second row, respectively;

a wiping unit to wipe the first nozzles and the second nozzles of the print head; and a controller to control the first nozzles and the second nozzles to spit sequentially as the nozzles are wiped by the wiping unit at a first time and a second time, respectively, according to an offset information between the first row and the second row.

26. An image forming apparatus, comprising:

a print head having first nozzles and second nozzles disposed on a first row and a second row, respectively;

a wiping unit to wipe a surface of the nozzles; and a control unit to control the first nozzles and the second nozzles to simultaneously spit in a mode and sequentially spit in another mode as the nozzles are wiped by the wiping unit.

27. A method of controlling an image forming apparatus, comprising:

acquiring offset information of a plurality of print heads having a plurality of nozzles arranged in a widthwise direction perpendicular to a feeding direction of a printing medium;

wiping a surface of the nozzles with a wiping unit;

acquiring position information of the wiping unit; and ejecting ink from the nozzles according to the position of the wiping unit, wherein the ejecting of the ink is performed sequentially as the nozzles are wiped.

28. The method of claim 27, wherein the nozzles are arranged in rows parallel to the feeding direction of the printing medium, and the ejecting of the ink is performed on a row-by-row basis.

29. The method of claim 28, wherein the ejecting of the inks from a first row of nozzles is performed before the ejection of the ink from a last row of nozzles.

30. The method of claim 27, wherein the ejecting of the inks is not performed simultaneously for all the nozzles.

31. A computer readable recording medium comprising computer readable codes to operatively control an image forming apparatus, comprising:

acquiring offset information of a plurality of print heads having a plurality of nozzles arranged in a widthwise direction perpendicular to a feeding direction of a printing medium;

wiping a surface of the nozzles with a wiping unit;

acquiring position information of the wiping unit; and ejecting ink from the nozzles according to the position of the wiping unit, wherein the ejecting of the ink is performed sequentially as the nozzles are wiped.

* * * * *